US006325747B1

(12) United States Patent
Norblom

(10) Patent No.: US 6,325,747 B1
(45) **Date of Patent: *Dec. 4, 2001**

(54) MARTIAL ARTS TRAINING DEVICE

(75) Inventor: Terry Lee Norblom, St. Louis Park, MN (US)

(73) Assignee: Center Ring Martial Arts, Inc., Chanhassen, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/416,204

(22) Filed: Oct. 8, 1999

Related U.S. Application Data

(63) Continuation of application No. 09/034,524, filed on Mar. 3, 1998, now Pat. No. 5,964,683.

(51) Int. Cl.[7] ..... A63B 21/02; A41D 13/08

(52) U.S. Cl. ..... 482/83; 482/88; 482/124

(58) Field of Search ..... 482/83, 88, 84–87; 2/16, 161 R, 2, 69.5; 602/14, 20, 18, 21, 40

(56) References Cited

U.S. PATENT DOCUMENTS

| | | | | |
|---|---|---|---|---|
| 4,942,624 | * | 7/1990 | Cho | 2/16 |
| 4,996,979 | * | 3/1991 | Grim et al. | 602/21 |
| 5,146,624 | * | 9/1992 | Bruckner | 2/18 |
| 5,530,967 | * | 7/1996 | Cielo | 2/20 |

* cited by examiner

*Primary Examiner*—Jerome Donnelly
(74) *Attorney, Agent, or Firm*—Merchant & Gould P.C.

(57) ABSTRACT

A martial arts training device is provided by the present invention. The martial arts training device includes an integrally constructed target pad and striking glove. The target pad is provided for protecting a wearer's forearm when an opponent strikes the pad. The striking glove is provided for protecting the wearer's hand when the wearer strikes another combatant or another target pad.

10 Claims, 2 Drawing Sheets

MARTIAL ARTS TRAINING DEVICE

"This application is a Continuation of application Ser. No. 09/034,524, filed Mar. 3, 1998, now Pat. No. 5,964,683 which application(s) are incorporated herein by reference."

FIELD OF THE INVENTION

This invention relates to a martial arts training device, and more particularly to a kickboxing training device which incorporates a target pad and striking glove to provide a more realistic training session.

BACKGROUND OF THE INVENTION

The sport of kickboxing involves a combat situation where opponents strike each other with their bands and feet. Kickboxing training has recently become very popular as an activity for providing aerobic exercise. Traditional training for kickboxing typically includes sparing situations where a first person holds a target pad and a second person strikes the pad numerous times. After awhile, the second person holds the target pad while the first person strikes it repeatedly. This type of exchange generally occurs numerous times during a training session. Commercially available pads worn on the forearm for this exercise are sold under the names Macho Martial Arts from Macho Products, Inc. of Sebastian, Florida; and Powerline™ from Century™.

During training, kickboxers often where gloves for protecting their hands. Commercially available kickboxing gloves are available under the names Everlast from Everlast® Sports Manufacturing Corporation of Bronx, N.Y. Macho Martial Arts from Macho Products, Inc. of Sebastian, Florida; Hitman® of DHB Capital Group, Inc. of Oakland Park, Fla. and Powerline™ from Century™.

SUMMARY OF THE INVENTION

A martial arts training device is provided by the present invention. The martial arts training device includes an integrally constructed target pad and striking glove. The target pad is provided for protecting a wearer's forearm, when the wearer is receiving strikes from another combatant. The striking glove is provided for protecting the wearer's hand when the wearer is striking either another combatant or a target pad.

The martial arts training device preferably includes a frame comprising a shield and a handle. The shield being received within the striking pad for receiving strikes and distributing the force of the strike against the wearer's forearm. The handle being received within the striking glove for allowing the wearer to hold onto the handle to provide further stability. The shield and the handle can be integrally constructed from a single material or they can be assembled together.

DETAILED DESCRIPTION OF THE INVENTION

Figure 1:
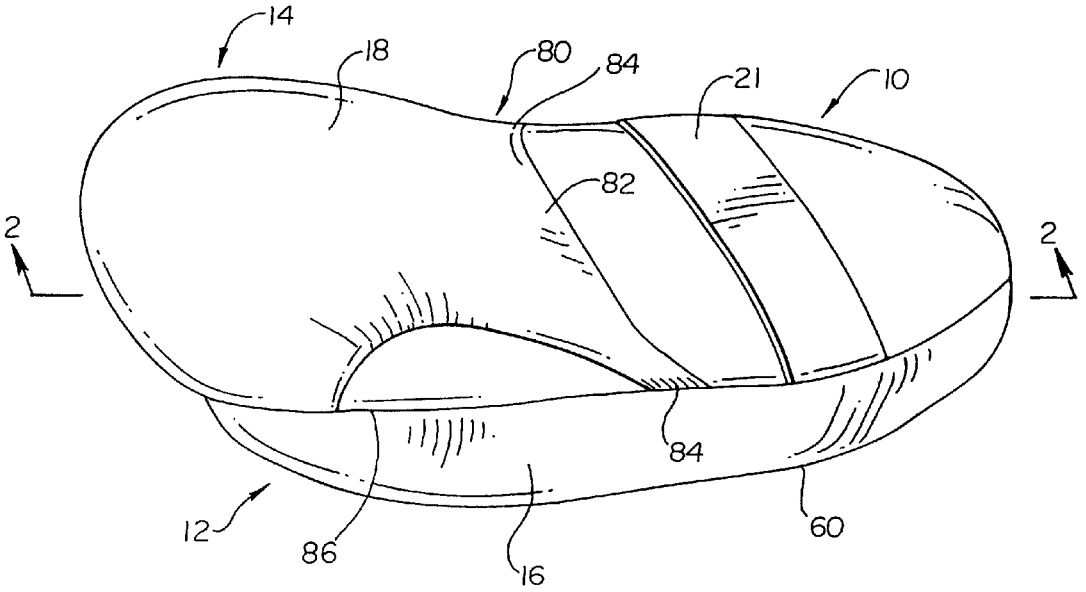
FIG. 1 is a perspective view of a martial arts training device according to the principles of the present invention.

With reference now to the various figures in which identical elements are identically numbered throughout, a description of the preferred embodiments of the present invention will now be provided. While the invention is disclosed in the context of a preferred embodiment, it will be appreciated that the invention includes numerous modifications from the preferred embodiment.

With reference to FIGS. 1–4, a martial arts training device is shown at reference numeral 10. It should be understood that the martial arts training device 10 can be used for a variety of the martial arts including boxing, karate, kickboxing, tae kown do, and kung-fu. A particularly preferred application of the martial arts training device 10 is as a kickboxing training device. While the following invention is described with respect to a kickboxing training device, it should be appreciated that the device has application in the other martial arts. The features of the martial arts training device 10 are particularly well adapted for kickboxing training.

The kickboxing training device 10 includes two general regions. The first region can be referred to as the forearm protector region 12 and the second region can be referred to as the hand protector region 14. In general, the forearm protector region 12 includes a target pad 16, and the hand protector region 14 includes a glove or mitt 18. The target pad 16 and the glove 18 are integrally attached to provide a unitary structure. It is an advantage of the present invention that the target pad 16 and the glove 18 can be used in a complementary fashion. That is, wearing the glove 18 assists in the use of the target pad 16 by helping to receive and distribute impacts delivered to the target pad 16. Similarly, it is expected that the target pad 16 assists the wearer of the glove 18 by helping to keep the wearer's fist and forearm structurally aligned in a desired striking motion, and by providing additional mass when the wearer is striking another object.

It should be understood that the kickboxing training device 10 is intended to be worn by a combatant in a kickboxing training exercise. The wearer or user inserts an arm into the device 10 so that the user's hand grips the handle 19 and the band 21 wraps around the user's arm to hold the target pad 16 against the user's forearm. The user can use the kickboxing training device 10 for delivering strikes against another object via the glove 18, and can receive strikes from an opponent via the target pad 16.

Kickboxing training devices according to the invention can be worn by both of the combatants in a kickboxing training exercise. Preferably, the devices are worn on each arm of the kickboxing combatants. By providing each combatant with the device, a more fluid sparring situation can be achieved compared with traditional kickboxing training techniques. The device allows the combatants to exchange and receive blows or strikes much more fluidly compared with prior art training devices which require one of the combatants to hold a target while the other combatant strikes at the target. After one of the combatants strikes the pad numerous times, they typically exchange the pads so that the other combatant has the opportunity to practice striking. In contrast, the kickboxing training device of the invention can be used so that the combatants do not have to exchange equipment during the training exercise. Rather, they can exchange punches more readily which provides for a more fluid and realistic kickboxing exercise.

A feature of the target pad 16 and the glove 18 which allows both components to work together is the presence of the frame 23 which includes a shield 24 and a frame handle 26. The shield 24 extend along a portion of the forearm protector region 12 and is sufficiently rigid so that it can withstand impacts and distribute the impacts across its surface. The shield 24 is a generally flat and wide and includes a force receiving surface 28 which is generally directed outward when the device is in use, and a force distributing surface 30 which rest against the user's forearm when the device is worn. While the training device 10 is worn, an opponent's strike against the target pad 16 will be received by the force receiving surface 28 and distributed across the wearer's forearm. The shield 24 is expected to receive forces resulting from kickboxing strikes thereon and distribute the force across its surface without fracturing.

The handle 19 is provided for gripping by the wearer's hand. It should be appreciated that while the device shown in FIGS. 1–4 is a left handed device, the invention includes a right handed device which can be practiced according to the teachings of the invention. Because the shield 24 and the frame handle 26 are attached together to form the frame 23, gripping the handle 26 will help keep the shield 24 is its proper position across the user's forearm, and it is expected that the gripping hand will absorb at least a portion of the force created by impacting the target pad 16.

Figure 4:
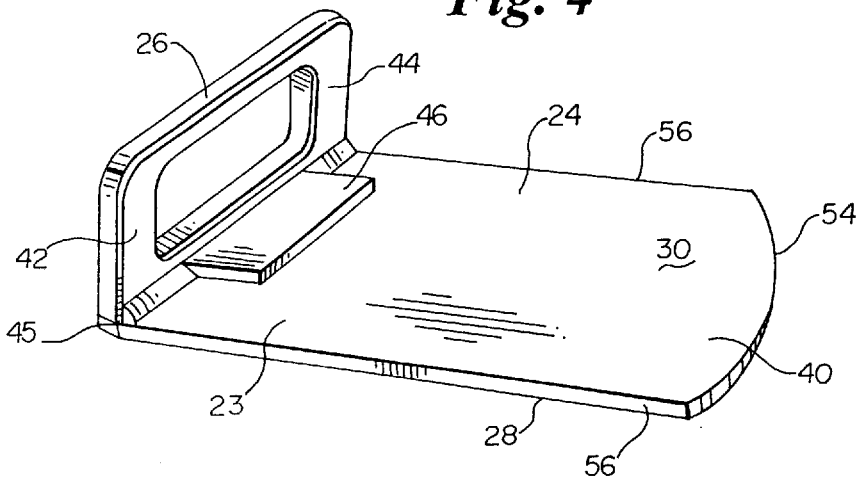
FIG. 4 is a perspective view of the frame of the martial arts training device.

As shown in FIG. 4, the shield 24 and the handle 26 are provided from two pieces of rigid material which are adhered together at the seam 45. An additional support piece 46 is glued in place in order to further assist in providing the frame 23 with the desired degree of structural stability. It should be appreciated, however, that the frame 23 can be manufactured from a single piece of rigid material by, for example, injection molding or by thermal forming. In a preferred embodiment, the rigid material 40 is a plastic sheet which has been bent or molded after heating to allow formation of the frame handle 26. The frame handle 26 and the shield 24 are connected together via the left and right arms 42 and 44. It should be appreciated that alternative way of attaching the shield 24 and the frame handle 26 can be practiced according to the present invention. For example, the handle can be bolted onto the shield to enhance the attachment.

Figure 5:
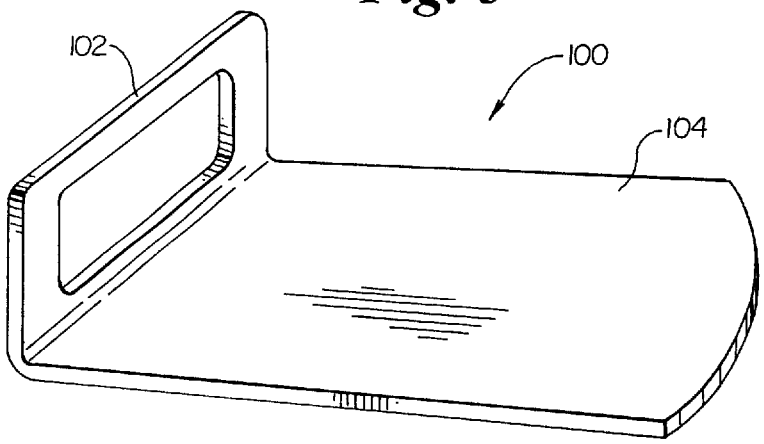
FIG. 5 is a perspective view of an alternative embodiment of the frame that can be used in the martial arts training device of the invention.

An alternative embodiment of the frame is shown at reference numeral 100 in FIG. 5. The frame 100 is formed from a sheet of plastic material which has been heated above its softening temperature and then molded to provide a handle 102 and a shield 104.

A strike receiving pad 50 is provided over the force receiving surface 28. The strike receiving pad 50 is provided to cushion the impact felt by the combatant striking the target pad 16. Preferably, the strike receiving pad 50 is a relatively thick foam pad 52 having a structure and thickness which is sufficient to absorb a strike inflicted by an opponent without harming the opponent. In the case of an open cell foam, it is expected that the thickness of the foam pad 50 will be between about 1½ and 3 inches, and preferably about 2 inches. Of course, this thickness of the foam pad 50 can be adjusted to account for foam density and for the desired degree of cushioning. The strike receiving pad 50 preferably extends several inches beyond the lower edge 54 and the side edges 56 of the shield 22 in order to provide sufficient protection and softening of the edges. Preferably, the edges 54 and 56 are rounded in order to avoid providing a sharp edge which may injure an opponent if the target pad 16 is struck incorrectly.

The foam pad 50 is covered with a skin 60 which holds the foam 50 in place. A forearm cushioning foam 62 is provided covering the force distributing surface 30 of the shield 24. The forearm cushioning foam 62 is provided to cushion the target pad 16 against the wearer's forearm and increase comfort. An additional foam wrist block 64 is provided as further comfort and to correctly position the wearer's hand within the device. Another skin 65 is provided covering the forearm cushioning foam 62 and the foam wrist block 64.

It should be understood that the shield 24, the foam pad 52, the forearm cushioning foam 62, and the foam wrist block 64 are all preferably attached together by adhesive. Alternatively, it should be understood that the foam pad 52 and the forearm cushioning foam 62 can be prepared from one foam material having a cutout region in which the shield 24 can be inserted.

The glove 18 is provided for protecting the hand of the wearer. The glove 18 includes a hand protecting foam 70 surrounded by an outer skin 72 and an inner skin 74. This structure is attached to the target pad 16 so that it covers the wearer's hand. Preferably, the inner skin 74 and the skin 65 are sufficiently resistant to moisture to prevent perspiration from seeping into the hand protecting foam 70 or the forearm cushioning foam 62. In addition, the material should resist rotting caused by contact with perspiration. The kickboxing training device preferably includes vent openings 80 along the sides of the glove 18 in order to promote cooling of the wearer's hand. It is expected that the wearer will use the surface 91 for delivering punches.

The frame handle 26 is preferably covered with a gripping material 75 which assists the wearer in holding onto the training device. Preferably, the gripping material 75 is a material which allows the wearer to grip it when the wearer's hand is wet. An exemplary preferred material is a rubbery material. It is expected that when the kickboxing training device 10 is worn, the wearer's thumb will wrap underneath the handle 19.

Figure 2:
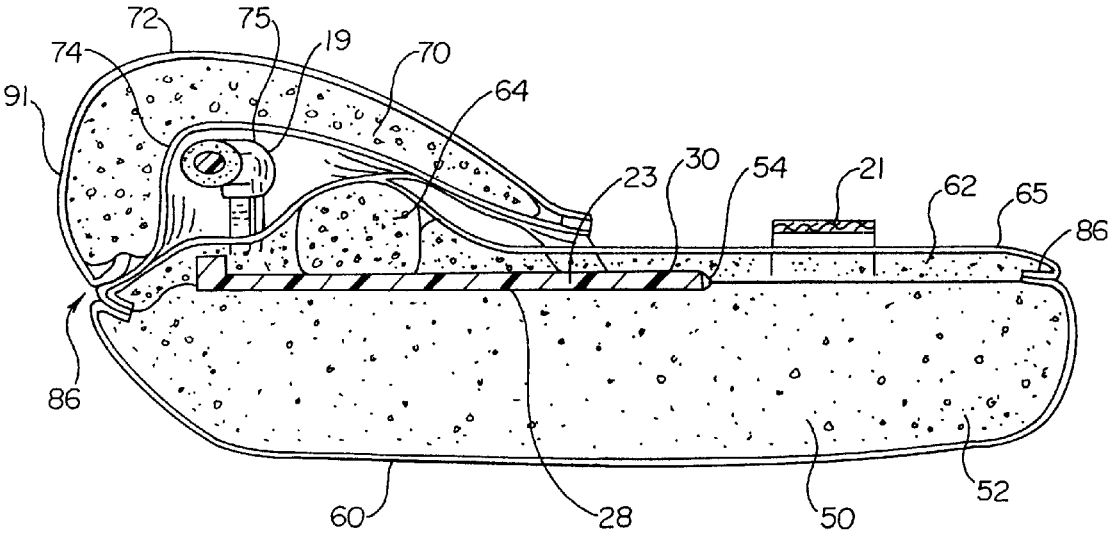
FIG. 2 is a sectional, side view of the martial arts training device according to FIG. 1.
Figure 3:
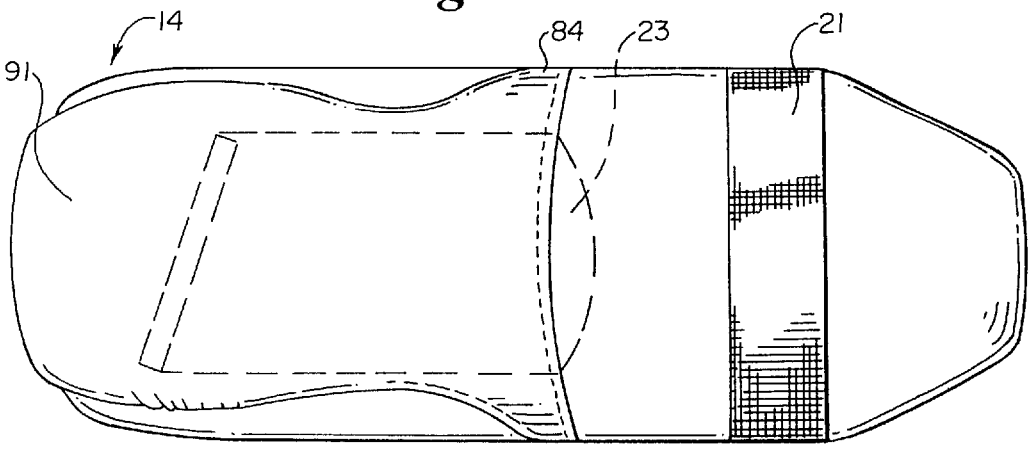
FIG. 3 is a top view of the martial arts training device of FIG. 1.

As shown in FIGS. 1 and 2, the rearward portion 82 of the glove 18 is anchored to the target pad 16 at tack lines 84. Furthermore, the skin components are all sewn together at the indicated seams 86. While the invention is described with respect to several separate skin components which are sewn together, it is contemplated that the kickboxing device can be manufactured from a single skin material.

The frame 23 is preferably manufactured from a plastic material which is sufficiently resilient to stresses resulting from receiving strikes and delivering strikes that it will not crack or disfigure during use. In addition, it is preferable that the fame 23 is made of a rigid material which is sufficiently light weight that it does not cause undue fatigue in the wearer. In a preferred embodiment, the rigid material is manufactured from a polyethylene terephthalate polymer, such as, glycol-modified polyethylene teraphthalate (PETG) which is available under the name Ultros PETG 6763 copolyester from Eastman Chemical Products, Inc. It is preferable that the frame 23 is manufactured from an amorphous material so that it will not embrittle upon aging as a result of crystallization.

It should be understood that the size of the martial arts training device can be altered to accommodate the different sizes associated with use by men, women, and children. It is expected that the length of the target pad, for example, will depend on the length of the user's forearm, and the size of the glove will depend on the size of the wearer's hand.

The skin is preferably a material which is sufficiently resistant to impact so that it can be used as a covering for a target pad and for a striking glove. In addition, because the skin will encounter moisture, primarily from sweat, it is expected that the skin should sufficiently resist damage caused by contact with moisture. A preferred skin material is a vinyl backed cloth. Furthermore, it is desirable for the skin to sufficiently cover the foam so that moisture does not absorb into the foam.

I claim:

1. A training device comprising:

(a) a combination target pad and striking glove;

(b) the target pad comprises a shield having a strike-receiving surface, and a strike-receiving pad provided over the strike-receiving surface;

(c) the striking glove comprises a hand protecting foam for protecting the backside of a wearer's hand;

(d) a handle for gripping extending into the striking glove; and (e) the shield and the handle are constructed and arranged so that when a wearer grips the handle, the shield extends along at least a portion of the wearer's forearm underside.

2. A training device according to claim 1, wherein the shield and the handle are attached together.

3. A training device according to claim 1, wherein the shield and the handle are formed from a continuous piece of plastic material.

4. A training device according to claim 1, wherein the shield and the handle comprise polyethylene terephthalate.

5. A training device according to claim 4, wherein the polyethylene teraphthalate comprises glycol-modified polyurethane terephthalate.

6. A training device according to claim 1, wherein the target pad comprises a strap for holding the target pad to a wearer's forearm.

7. A training device according to claim 1, wherein the shield comprises a force distributing surface, and the training device further comprises a forearm cushioning foam provided over the force distributing surface for providing cushioning along the wearer's forewarn underside.

8. A training device according to claim 7, further comprising a foam wrist block.

9. A training device according to claim 1, wherein the striking glove comprises an outer skin and an inner skin for covering the hand protecting foam.

10. A training device according to claim 1, wherein the strike receiving pad has a thickness of between about 1½ inch and about 3 inches.

* * * * *